US010053351B2

(12) United States Patent
Van Der Weij

(10) Patent No.: US 10,053,351 B2
(45) Date of Patent: Aug. 21, 2018

(54) VALVE FOR DISPENSING A LIQUID AND OPTIONALLY AERATING IT

(71) Applicant: APDS ORIGINALS B.V., Almere (NL)

(72) Inventor: Fedde Van Der Weij, Almere (NL)

(73) Assignee: APDS ORIGINALS B.V., Almere (NL)

( * ) Notice: Subject to any disclaimer, the term of this patent is extended or adjusted under 35 U.S.C. 154(b) by 1 day.

(21) Appl. No.: 15/508,442

(22) PCT Filed: Sep. 4, 2014

(86) PCT No.: PCT/EP2014/068851

§ 371 (c)(1),
(2) Date: Mar. 2, 2017

(87) PCT Pub. No.: WO2016/034237

PCT Pub. Date: Mar. 10, 2016

(65) Prior Publication Data

US 2017/0297886 A1 Oct. 19, 2017

(51) Int. Cl.
*B67D 1/00* (2006.01)
*B67D 1/14* (2006.01)
(Continued)

(52) U.S. Cl.
CPC ..... *B67D 1/0045* (2013.01); *B01F 3/04787* (2013.01); *B01F 5/008* (2013.01);
(Continued)

(58) Field of Classification Search
CPC .... B01F 3/04787; B01F 5/008; B01F 5/0428; B01F 2003/04872; B01F 2005/0436;
(Continued)

(56) References Cited

U.S. PATENT DOCUMENTS 4,595,121 A 6/1986 Schultz
4,648,534 A * 3/1987 Esser ..... B67D 1/0412 222/373

(Continued)

FOREIGN PATENT DOCUMENTS

AU 2002301203 A1 6/2003
AU 2013204096 A 2/2014

(Continued)

OTHER PUBLICATIONS

International Search Report and Written Opinion for International patent application No. PCT/EP2014/068851, dated Feb. 27, 2015.

*Primary Examiner* — Frederick C Nicolas
(74) *Attorney, Agent, or Firm* — Steven M. Koehler; Westman, Champlin & Koehler, P.A.

(57) ABSTRACT

A valve for dispensing a liquid includes a housing, an internal liquid passage extending through the housing, a valve seat, a valve member movable between a closed position engaging the valve seat and an open position disengaging the valve seat, and a control member controlling movement of the valve member, which is movable between a first position in which it engages the valve member in its closed position, a second position in which the valve member is in its open position but still engaging the control member and a third position in which the valve member is in its open position and out of engagement with the control member. At least one air passage connects the outside of the valve with the internal liquid passage. The at least one air passage is closed in the first and second positions of the control member and is opened in the third position.

24 Claims, 8 Drawing Sheets

(51) Int. Cl.
*B01F 3/04* (2006.01)
*B01F 5/00* (2006.01)
*B01F 5/04* (2006.01)

(52) U.S. Cl.
CPC ..... *B01F 5/0428* (2013.01); *B67D 1/0004* (2013.01); *B67D 1/1455* (2013.01); *B01F 2003/049* (2013.01); *B01F 2003/04872* (2013.01); *B01F 2005/0436* (2013.01); *B01F 2215/0072* (2013.01)

(58) Field of Classification Search
CPC ..... B01F 2215/0072; B01F 2003/049; B67D 1/0045; B67D 1/0004; B67D 1/1455
See application file for complete search history.

(56) References Cited

U.S. PATENT DOCUMENTS 5,244,117 A * 9/1993 Lombardo ..... B67D 1/0456 141/3
5,850,908 A * 12/1998 Jasek ..... B65D 47/283 220/203.23
6,041,970 A * 3/2000 Vogel ..... B67D 1/0016 222/129.1
6,708,741 B1 3/2004 Berry
8,220,666 B2 * 7/2012 Abe ..... A47K 5/1204 222/181.2
2013/0240562 A1 9/2013 Middleton
2014/0091107 A1 4/2014 Becker
2014/0291350 A1 10/2014 Middleton
2017/0283234 A1 * 10/2017 Van Der Weij ..... B67D 1/0001

FOREIGN PATENT DOCUMENTS

CN 201372191 Y 12/2009
CN 201958676 U 9/2011
CN 202269919 U 6/2012
CN 202346740 U 7/2012
FR 2601747 A1 1/1988
GB 2473744 A 3/2011

* cited by examiner

VALVE FOR DISPENSING A LIQUID AND OPTIONALLY AERATING IT

CROSS-REFERENCE TO RELATED APPLICATION

The present application is a national stage of and claims priority of International patent application Ser. No. PCT/EP2014/068851, filed Sep. 4, 2014, and published in English as WO2016/034237 A1, the content of which is hereby incorporated by reference in its entirety.

BACKGROUND

The discussion below is merely provided for general background information and is not intended to be used as an aid in determining the scope of the claimed subject matter.

The invention firstly relates to a valve for dispensing a liquid, comprising a housing, an internal liquid passage extending through the housing between an inlet and an outlet, a valve seat, a valve member which is movable between a closed position engaging the valve seat for closing the liquid passage and an open position disengaging the valve seat for opening the liquid passage, and control controlling the movement of the valve member between its closed and open positions.

A valve of this type may be useful in combination with a beverage dispenser in which beverages that are contained and sold in bag-in-box packagings (BIB) are used (but it is not limited to such an application). This type of packaging is well known on the market and is used for many kinds of beverages like wine, fruit juice, water, spirits and others. Beverages stored in BIB have in common that they are non-carbonised because the packaging cannot be used under pressure. For wine this means that only 'still' wines can be stored. Another characteristic of wine stored in BIB packaging is that the packaging cannot be used for aging the wine to improve its quality, like in glass bottles. A typical wine stored in BIB packaging is in most cases a relative young wine.

It is a known that young wines contain more acids (like sulphite), ethanol and tannins. Letting wine 'breath' is one way to get rid of some of the sharp edges that come with these ingredients. A known technique for letting wine breath is decanting in a decanter or in a glass, or by aeration, which involves bringing wine into contact with air by mixing wine with little air bubbles during the pouring process. Aeration triggers evaporation and oxidation of the above mentioned components, which results in subtle but noticeable softening of the taste and an enhancement of the aromas. Aeration also may increase the oxygen saturation in liquids.

Aeration can also be beneficial for other beverages. Water, for instance, can contain gasses like hydrogen sulphur, chlorine, methane or carbon dioxide. Aeration promotes the release of these gasses and improves the taste and overall quality.

Thus, in general aeration improves the overall quality of the beverages. However, in certain cases aeration to the contrary causes a reduction of the more appreciated bouquet of wine or loss of subtle flavour characteristics.

The state of the art already shows aerators that can be used to aerate wine or other liquids. Some can be placed on a bottle and aerate during pouring out, whereas others are placed above a glass and aerate when wine is poured into the aerator that releases aerated wine in the glass. Examples of both types are disclosed in AU-A-2013204096, CN-Y-201372191, GB2473744, CN-U-202346740, CN-U-201958676 and CN-U-202269919. These aerators all use the Venturi principle for mixing fluid with air. This is a proven concept that works very well with low pressure and flow of the fluid and air.

However, none of the state of the art aerators allows a user to make a choice between dispensing with or dispensing without aeration.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

A valve for dispensing a liquid with an integrated, switchable aerating function, so the user can choose whether to aerate or not during dispensing is disclosed.

The valve includes a control member which is movable between a first position in which it engages the valve member for keeping it in its closed position, a second position in which the valve member is in its open position but still in engagement with the control member and a third position in which the valve member is in its open position and out of engagement with the control member, wherein at least one air passage is defined between the valve member and control member for connecting the outside of the valve with the internal liquid passage and wherein said at least one air passage is closed in the first and second positions of the control member and is opened in the third position of the control member.

In the first position of the control member the valve is closed and no liquid is dispensed. In the second position of the control member the valve is open, but the air passage between the valve member and control member is still closed and liquid is dispensed without aeration. In the third position both the valve and air passage are open and liquid is dispensed with aeration. Air enters the air passage from the outside (surroundings) of the valve and mixes with the liquid at the junction between the air passage and the internal liquid passage within the valve.

In one embodiment of the valve, the valve member and housing have cooperating abutments for defining the open position of the valve member. Such abutments allow an easy operation of the valve by a user.

For example, the housing may comprise a circumferential step whereas the valve member then comprises a circumferential protrusion for cooperation with said circumferential step.

For assuring that the valve member rests in its closed position (engaging the valve seat) when the valve is not manipulated by a user, it is conceivable that the control member is biased to its first position.

For example, the control member may be biased by a spring, such as a compression spring, positioned between the housing and the control member.

Generally, when the control member moves from its first position towards its second position, the pressure of the liquid on the valve member and/or the gravity force on the valve member will be sufficient to move the valve member towards its open position. If this, however, cannot be assured, it is conceivable that the valve member is biased to its open position, wherein the bias on the valve member is less than the bias on the control member. The difference in bias is needed to assure that the valve member does not move towards its open position before the control member is operated.

Also in such an embodiment the valve member may be biased by a spring, such as a compression spring, positioned between the housing and the valve member.

In yet another embodiment of the valve the control member is provided with at least one operating tab protruding outwardly through an opening in the housing. This operating tab may be engaged by a finger of a user (or by another external operating mechanism) to move the control member.

Preferably, then, the valve is provided with two operating tabs positioned diametrically opposite to each other, leading to symmetrical forces and thus the need for lower operating forces.

In one embodiment of the valve, the valve member is provided with a liquid collector which in a liquid tight and movable manner engages the valve seat and which defines a first inner liquid channel that in the open position of the valve member communicates with a valve passage through the valve seat. Such a liquid collector assures that the liquid passing the valve member reaches the place where the air passage ends.

In this embodiment it further is conceivable that the liquid collector has circumferential inner and outer surfaces, whereas the control member defines a second inner liquid channel communicating with the first inner liquid channel of the liquid collector and has a circumferential inner surface, whereas the at least one air passage is defined as an annular channel that extends between the circumferential outer surface of the liquid collector and the circumferential inner surface of the control member and that debouches into the second inner liquid channel, wherein in the first and second positions of the control member the circumferential inner surface of the control member in a sealing manner engages the circumferential outer surface of the liquid collector for closing said annular channel, whereas in the third position of the control member the circumferential inner surface of the control member disengages the circumferential outer surface of the liquid collector for opening said annular channel.

The liquid flowing out of the first inner liquid channel of the liquid collector into the second inner liquid channel causes a Venturi effect which in the third position of the control member causes air to flow through the air passage towards the second inner liquid channel for a mixing with the liquid leaving the liquid collector.

When further the circumferential inner surface of the control member and the circumferential outer surface of the liquid collector taper, this will define a tapering annular channel which also has a favorite effect on the operation.

The mixing may further be promoted when the annular channel in the region where it debouches into the second inner liquid channel is provided with turbulators.

For example, in an embodiment of the valve in which the second inner liquid channel of the control member has a narrowed throat in the region where the annular channel debouches into it, the turbulators may be positioned immediately before said narrowed throat. Behind the throat the second inner liquid channel again widens, leading to an expansion of the air/liquid mixture (generally leading to a better mixing effect).

Constructively said turbulators may comprise a circumferential step in the circumferential inner surface of the control member. The air arriving from the air passage (the annular channel) impinges on said turbulators causing turbulence improving the mixing of liquid and air bubbles.

It is also possible that in at least one of the circumferential inner surface of the control member and the circumferential outer surface of the liquid collector longitudinal grooves are provided. This again may promote an effective mixing (aeration) by directing the air in a defined direction and by promoting the formation of air bubbles.

The outlet of the valve may be provided with a restrictor for forming a well-defined jet of liquid spraying out of the valve.

In another embodiment of the valve, a connector is provided at its inlet for allowing a liquid tight connection between the valve and a spigot or spout of a liquid reservoir, such as a flexible bag. As a result the valve may be connected to the spigot or spout of such a flexible bag in an easy way.

In a second aspect, the invention relates to a liquid dispensing device for use with a flexible bag containing said liquid and having a spigot or spout connected thereto, which device comprises a housing for receiving the bag, which housing is provided with a receiver for receiving the spigot or spout. The receiver comprises a valve of which the inlet is provided with a connector adapted for realizing a liquid tight connection between the valve and the spigot or spout of the flexible bag.

In an embodiment of such a liquid dispensing device, the valve is provided in an upper part of the housing and wherein the housing further is provided with a support member for the flexible bag, which support member is movable between a lowermost position remote from the valve for supporting a full bag and an uppermost position near to the valve for supporting a substantially empty bag.

In this embodiment the valve is located at such a high level that for filling a glass with the liquid (beverage) the device does not have to be positioned on an elevated support nor has to be lifted by a user.

In yet another embodiment, then, the support member has an inclined upper support surface sloping down to the side of the valve. This ensures that the bag is completely emptied.

The valve offers a number of advantages. It may act as a normal valve that opens or closes a channel for liquids such as beverages and it can control and provide an aeration function. In some embodiments it further offers a universal interface for connection to a liquid source (i.e. a spigot or spout of a bag in box packaging containing a beverage such as wine). The valve further is aimed to offer a compact size, to be easy and cheap to make, fit for wine and other beverages, whereas further the standard valve function and the aerate function are combined in one actuating action.

BRIEF DESCRIPTION OF THE DRAWINGS

Hereinafter aspects of the invention will be elucidated while referring to the drawing, in which.

DETAILED DESCRIPTION

Figure 1:
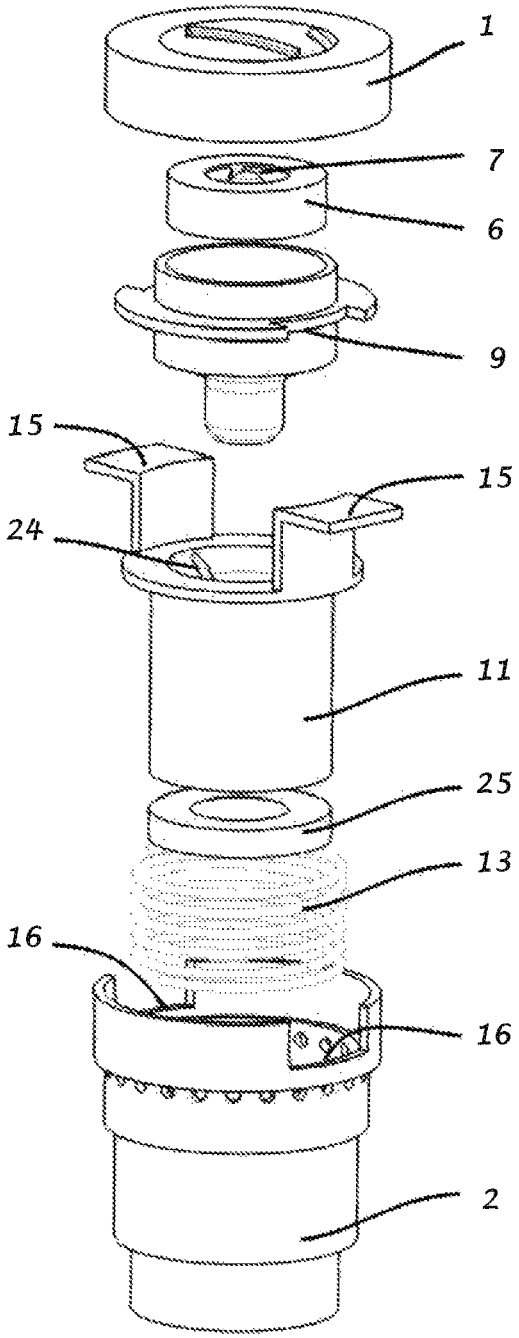
FIG. 1 in an exploded view shows an embodiment of the valve.

Firstly referring to FIGS. 1 and 2A-2C, an embodiment of a valve for dispensing a liquid is illustrated. The valve comprises a housing with a housing top 1 and a lower housing 2. An internal liquid passage of which the constituent parts will be described below, extends through the housing 1,2 between an upper inlet 3 and a lower outlet 4 (both being parts of the internal liquid passage).

The housing top 1 internally is provided with a valve seat 5 which cooperates with a central cone 7 of a valve member 6 which (as will appear below) is movable between a closed position engaging the valve seat 5 for closing a valve passage 8 (which also is part of the internal liquid passage) and an open position disengaging the valve seat 5 for opening the valve passage 8.

The valve member 6 is provided with (or attached to) a liquid collector 9 which in a movable manner engages the outer face of the valve seat 5 (in the illustrated embodiment the liquid collector 9 engages the outside of the valve seat 5 not directly, but indirectly through the valve member 6) and which defines a first inner liquid channel 10 (also being part of the internal liquid passage) that in the open position of the valve member 6 (cone 7 disengaging the valve seat 5) communicates with the valve passage 8 through the valve seat 5.

It is noted that below (with respect to FIGS. 5A-5C) an alternative embodiment will be described in which between the liquid collector 9 (or valve member 6) and the outer face of the valve seat 5 a seal member is provided.

The valve further comprises a control member 11 for controlling the movement of the valve member 6 between its closed and open positions. As will appear further below, the control member 11 is movable between a first position in which it engages the valve member 6 for keeping it in its closed position (central cone 7 engaging the valve seat 5), a second position in which the valve member 6 is in its open position (central cone 7 disengaging the valve seat 5) but still is in engagement with the control member 11 and a third position in which the valve member 6 also is in its open position and further the liquid collector 9 is out of engagement with the control member 11, such that in this third position at least one air passage is opened for connecting the outside of the valve with the internal liquid passage.

The lower housing 2 comprises an internal circumferential step 12 cooperating with a circumferential protrusion 37 (of the liquid collector 9 of the valve member 6) for defining the open position of the valve member.

The control member 11 is biased to its first position (for closing the valve member) by a compression spring 13 positioned between the lower housing 2 and the control member 11.

Figure 2A:
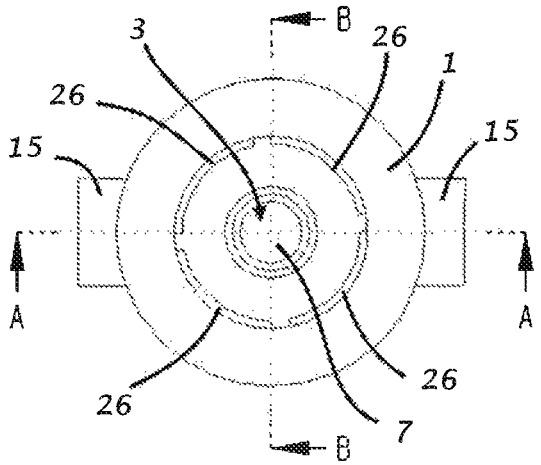
FIG. 2A shows a top plan view of the valve.
Figure 2B:
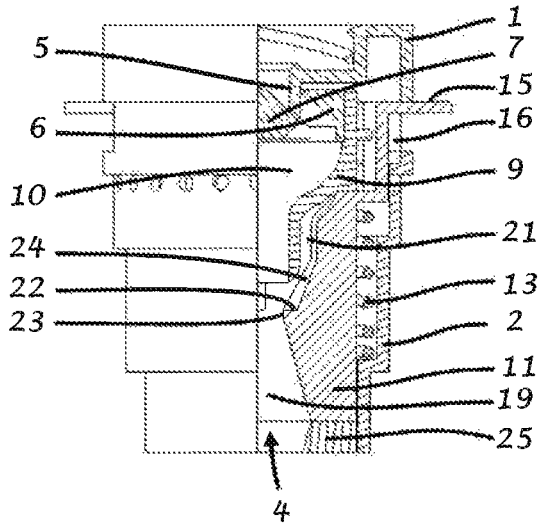
FIG. 2B shows a combined side elevational view (left) and a vertical cross section according to A-A in FIG. 2A (right)
Figure 2D:
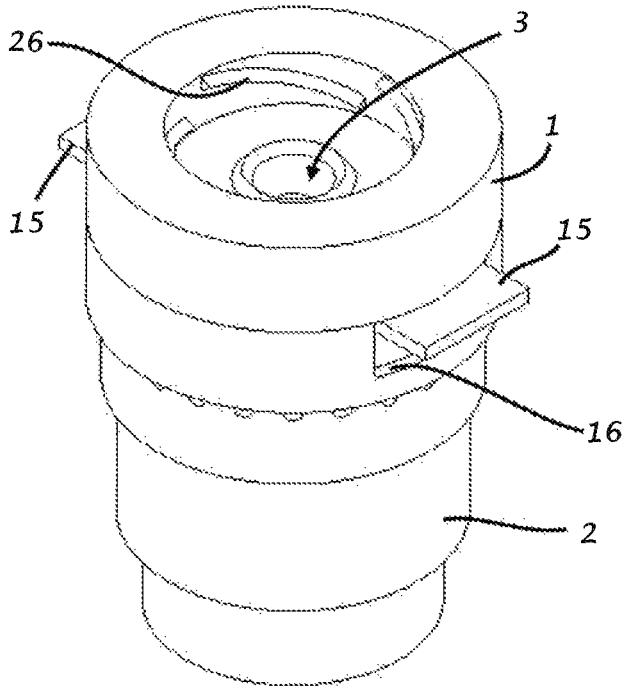
FIG. 2D shows a perspective view of the valve.
Figure 2C:
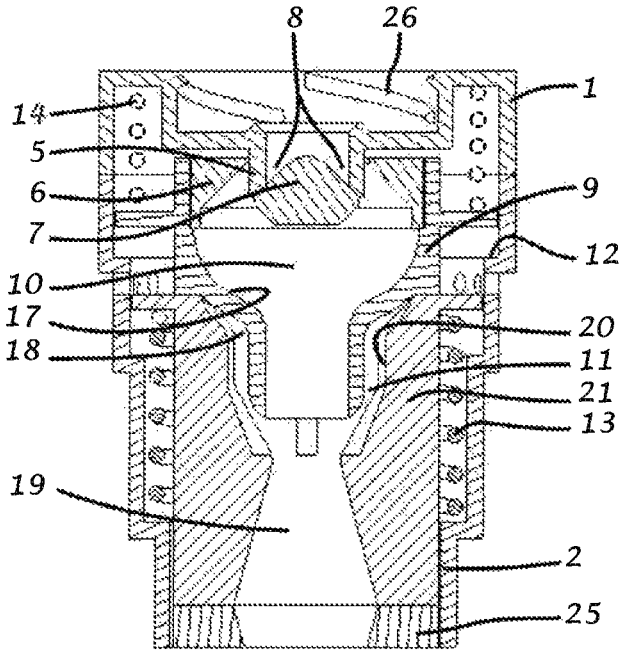
FIG. 2C shows a section according to B-B in FIG. 2A.

It has been illustrated schematically in dotted lines in FIG. 2C that the valve member 6 (liquid collector 9) also may be biased to its open position by a compression spring 14 positioned between the housing top 1 and the valve member 6 (or liquid collector 9). Generally the bias on the valve member 6 (or liquid collector 9) is less than the bias on the control member 11.

The control member 11 is provided with two operating tabs 15 positioned diametrically opposite to each other and protruding outwardly through corresponding openings 16 in the lower housing 2.

The liquid collector 9 has circumferential inner and outer surfaces 17 and 18 (see FIGS. 2C and 3C) respectively (which in this embodiment taper in a downward direction). The inner surface 17 thus defines a narrowing shape of the first inner liquid channel 10.

The control member 11 defines a second inner liquid channel 19 (also defining part of the internal liquid passage of the valve) communicating with the first inner liquid channel 10 of the liquid collector 9. The control member 11 further has a circumferential inner surface 20 (in this embodiment likewise tapering) and an annular tapering channel 21 extends between the circumferential outer surface 18 of the liquid collector 9 and the circumferential inner surface 20 of the control member 11. This channel 21 debouches into the second inner liquid channel 19, just below the lower end of the liquid collector 9.

In the region where the annular channel 21 debouches into the second inner liquid channel 19, it is provided with turbulators. These turbulators are shaped as a circumferential step 22 in the circumferential inner surface 20 of the control member 11. Further it is clearly visible that the second inner liquid channel 19 of the control member 11 has a narrowed throat 23 in the region where the annular tapering channel 21 debouches therein. The turbulators (step 22) are positioned immediately before (above) said narrowed throat 23.

The circumferential inner surface 20 of the control member 11 is provided with longitudinal grooves 24 and the outlet 4 of the valve is surrounded by a restrictor 25. At the inlet 3 of the valve connector, for example, a thread 26 is provided for allowing a liquid tight connection between the valve and a spigot or spout of a liquid reservoir, such as a flexible bag.

The valve operates in the following manner: in the starting position (FIG. 3A) of the valve, the control member 11 is kept in its first position by the compression spring 13 in which a horizontally extending part 20' of the circumferential inner surface 20 of the control member 11 in a sealing manner engages the circumferential outer surface 18 of the liquid collector 9 for closing the annular tapering channel 21. Further the valve member 6 with its central cone 7 is kept in engagement with the valve seat 5 for keeping the valve in its closed position, notwithstanding any liquid pressure P (or gravity). When the control member 11 (by pressing downwards the operating tabs 15) is moved down against the force of compression spring 13 (over distance $h_1$) towards its second position (FIG. 3B) in which step 12 of the lower housing 2 engages protrusion 37 of the valve member 6, the valve member 6 with liquid collector 9 will move to its open position in which the central cone 7 has disengaged the valve seat 5 and liquid can flow through the valve passage 8, the first inner liquid channel 10 in the liquid collector 9 and the second liquid channel 19 in the control member 11 towards the outlet 4. In this position the part 20' of the circumferential inner surface 20 of the control member 11 still engages the circumferential outer surface 18 of the liquid collector 9 in a sealing manner for closing the annular tapering channel 21. Thus, the valve is in a position for dispensing the liquid without aeration.

The movement of the valve member 6 away from the valve seat 5 may occur through gravity or the pressure of the liquid P at the inlet 3, but may also be aided by the compression spring 14, if provided.

Pressing the control member 11 further down (over distance $h_2$), brings the control member 11 in its third position (for example a position according to FIG. 3C in which a circumferential edge 27 thereof engages a circumferential step 28 of the lower housing 2) in which the valve member 6 with its cone 7 remains in its open position free from the valve seat 5, and in which position further said part 20' of the circumferential inner surface 20 of the control member 11 disengages the circumferential outer surface 18 of the liquid collector 9 for opening the annular tapering channel 21. As a result an air flow 29 through holes 38 in the lower housing 2 and through channel 21 is defined for connecting the outside of the valve with the internal liquid passage (specifically the second internal liquid channel 19). The air arriving via the channel 21 impinges on the circumferential step 22 for increasing the mixing effect. The liquid spraying out of the lower end 30 of the tapering first liquid channel 10 of the liquid collector 9 causes suction through a Venturi effect for sucking in the air through the channel 21 and a mixing will occur between liquid and air, leading to an aeration of the liquid. The lower part of the grooves 24 facilitate the transport of air bubbles that are formed where the liquid and air meet. The number, size and orientation of the grooves may vary.

Behind the throat 23 the expanding shape of the second inner liquid channel 19 promotes the mixing and the formation of a laminar liquid flow which finally will leave the valve through the restrictor 25 at the outlet 4.

Figure 3A:
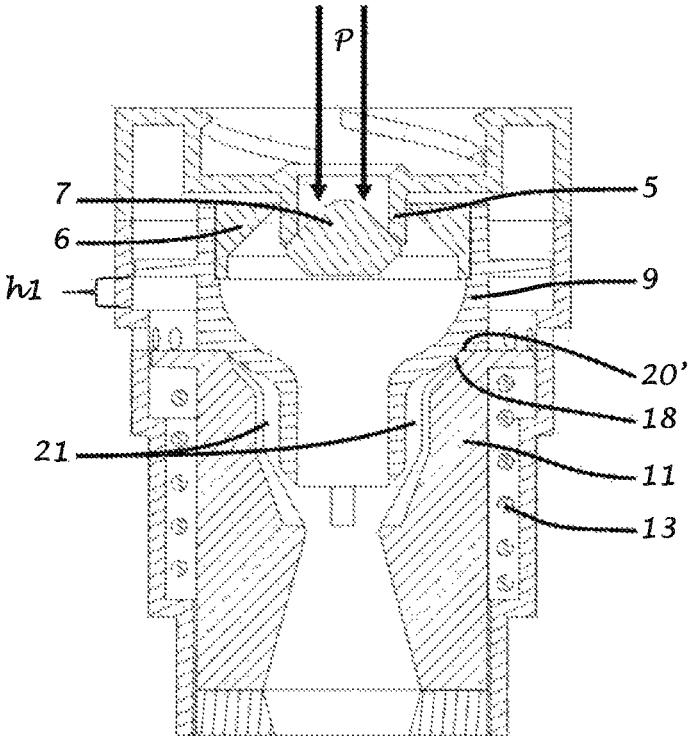
FIG. 3A shows a vertical cross section according to FIG. 2C with the valve closed.
Figure 3B:
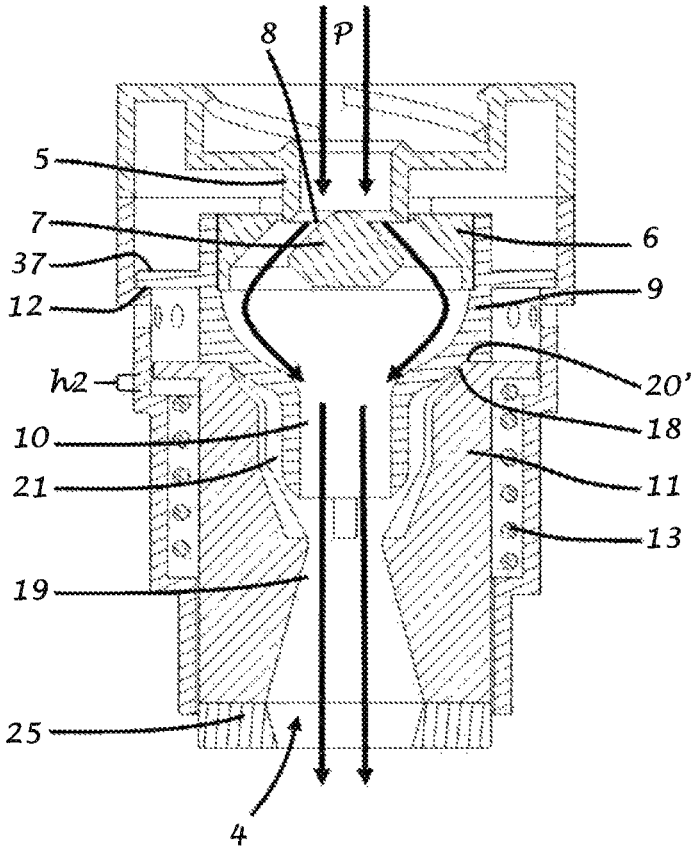
FIG. 3B shows a vertical cross section according to FIG. 2C with the valve open without aeration.

In FIG. 3A the distance $h_1$ defines the distance over which the control member 11 moves between its first and second positions, whereas in FIG. 3B the distance $h_2$ defines the distance over which the control member 11 moves between its second and third positions. These distances may differ.

Figure 4:
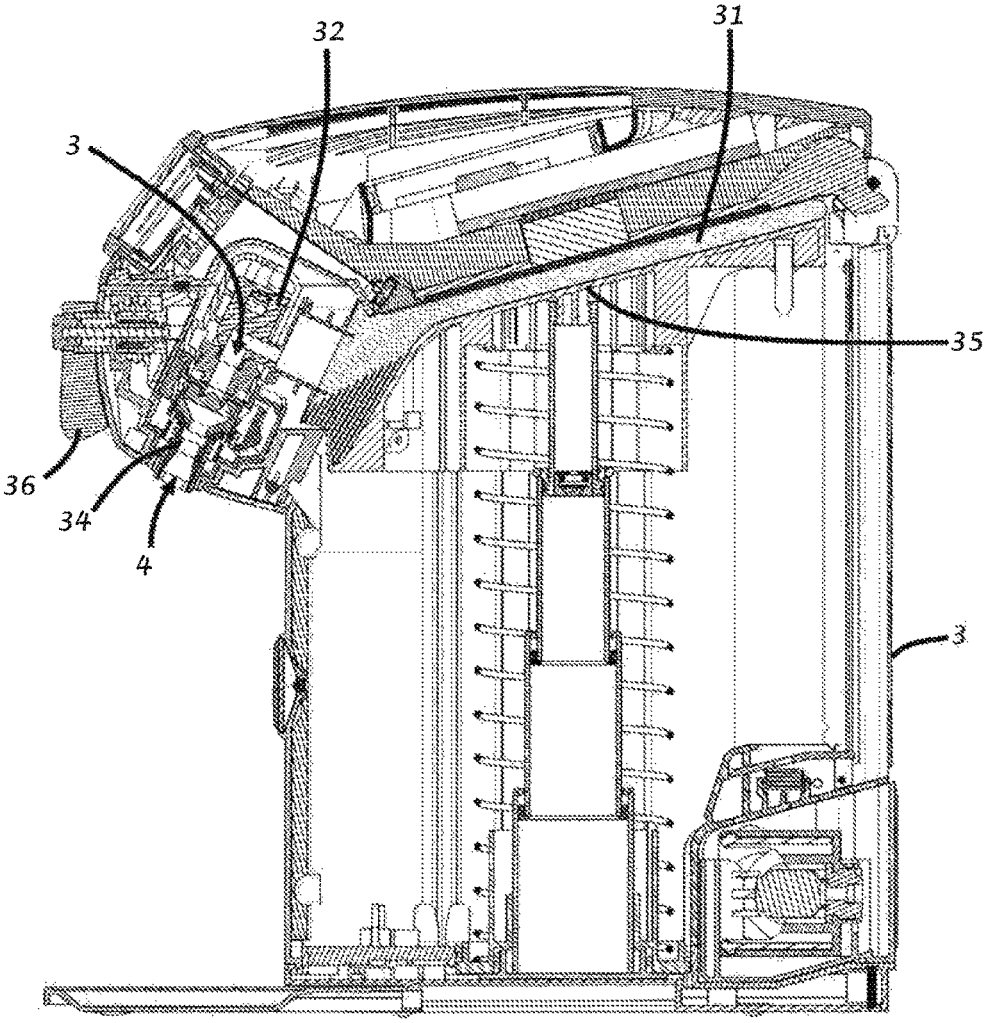
FIG. 4 illustrates a vertical cross section of an embodiment of a liquid dispensing device.

FIG. 4 illustrates a liquid dispensing device for use with a flexible bag containing said liquid and having a spigot or spout 32 connected thereto. This device comprises a housing 33 for receiving the bag, which housing is provided with a valve 34 the inlet 3 is provided with a connector (not shown in detail here, but for example embodied as a thread 26 as shown in FIGS. 2C and 3D) adapted for realizing a liquid tight connection between the valve 34 and the spigot or spout 32 of the flexible bag 31.

In this device the movement of the control member of the valve 34 is caused by an operating lever 36 which may be manipulated (for example rotated) manually and which by a transmission not indicated in detail, is connected to the control member.

The valve 34 is provided in the housing 33 and the housing further is provided with a support member 35 for the flexible bag, which support member 35 is movable between a lowermost position remote from the valve 34 for supporting a full bag and an uppermost position (illustrated in FIG. 4) near to the valve for supporting a substantially empty bag. The support member 35 has an inclined upper support surface sloping down to the side of the valve 34, such that it is assured that almost all liquid will reach the valve 34.

Figure 3C:
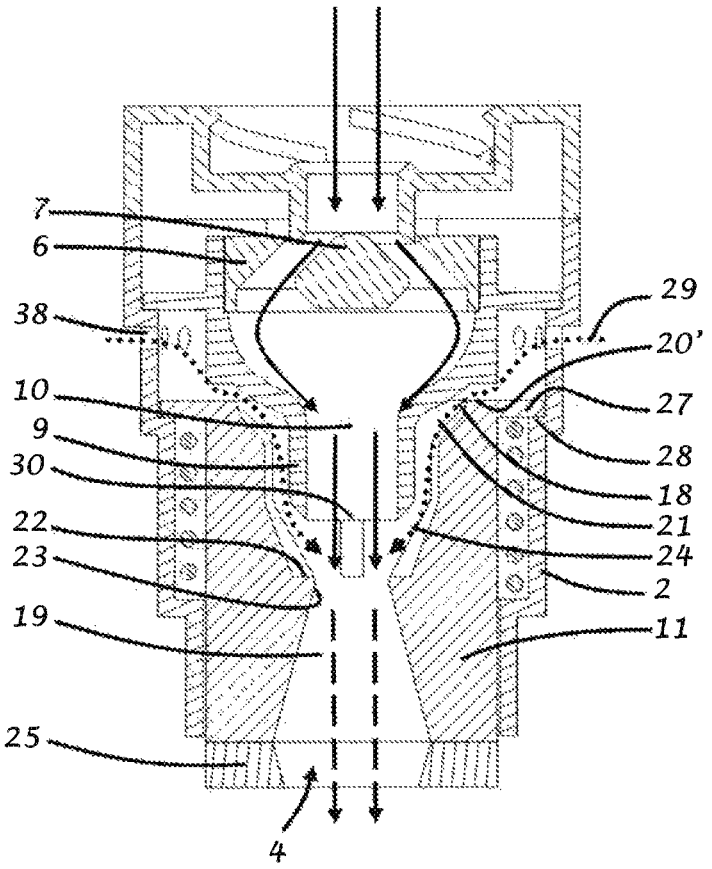
FIG. 3C shows a vertical cross section according to FIG. 2C with the valve open with aeration.
Figure 5A:
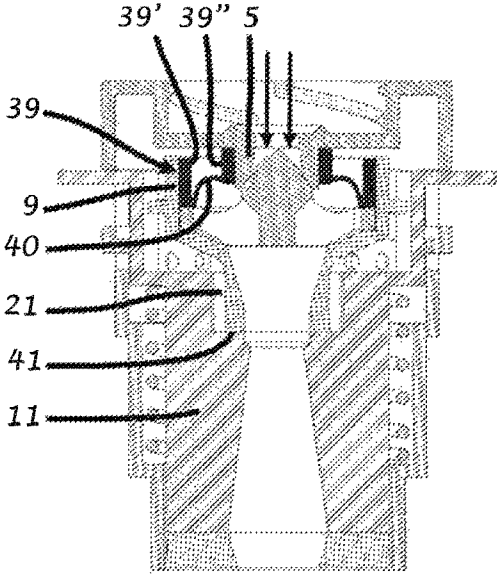
FIGS. 5A-5C show vertical cross sections of an alternative embodiment of the valve in three different positions in correspondence with FIGS. 3A-3C.
Figure 5B:
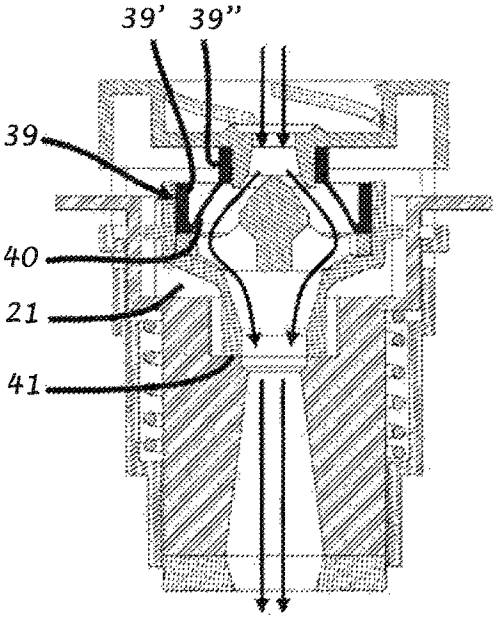
Figure 5C:
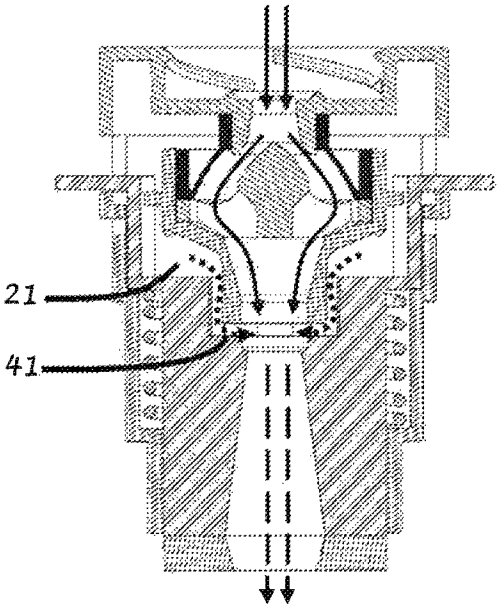

In FIGS. 5A-5C an alternative embodiment of the valve is shown in three different positions in correspondence with FIGS. 3A-3C (closed, open without aeration and open with aeration, respectively). This alternative embodiment basically has the same design as the previous embodiment, apart from a few differences of which the three most important ones are described below.

Firstly, one can see that in this embodiment the liquid collector 9 engages the valve seat 5 through a deformable seal member 39. This seal member 39 with an outer part 39' is attached to the liquid collector 9 and with an inner part 39" is attached to the valve seat 5. These outer and inner parts 39',39" are connected by a flexible web 40 allowing the relative movement between these outer and inner parts and thus between the liquid collector 9 and valve seat 5. It is noted, that the seal member 39 also may function in a manner similar to compression spring 14 illustrated in FIG. 2C.

Secondly, the lower end of the liquid collector 9 in the positions without aeration (FIGS. 5A and 5B) will, in a sealing manner, engage a shoulder 41 of the control member 11 for closing the channel 21 (thus at a position different from the embodiment according to FIGS. 3A-3C, especially at a lower position).

Finally, as yet another difference, the overall shape of the internal liquid passage has slightly changed for improving the Venturi effect. Such changes of the shape may be reflected in features such as, for example, different angles and distances between, and different diameters of parts.

The invention is not limited to the embodiments described before which may be varied widely within the scope of the invention as defined by the appending claims.

The invention claimed is:

1. A valve for dispensing a liquid, comprising a housing, an internal liquid passage extending through the housing between an inlet and an outlet, a valve seat, a valve member configured to move between a closed position engaging the valve seat for closing the internal liquid passage and an open position disengaging the valve seat for opening the internal liquid passage, and a control member configured to control movement of the valve member between the closed and open positions, wherein the control member is configured to move between a first position in which the control member engages the valve member for keeping the valve member in the closed position, a second position in which the valve member is in the open position but still in engagement with the control member and a third position in which the valve member is in the open position and out of engagement with the control member, wherein at least one air passage is defined between the valve member and the control member to connect an outside of the valve with the internal liquid passage and wherein said at least one air passage is closed in the first and second positions of the control member and is opened in the third position of the control member.

2. The valve according to claim 1, wherein the valve member and the housing have cooperating abutments to define the open position of the valve member.

3. The valve according to claim 2, wherein the housing comprises a circumferential step and the valve member comprises a circumferential protrusion for cooperation with said circumferential step.

4. The valve according claim 1, wherein the control member is biased to the first position.

5. The valve according to claim 4, wherein the control member is biased by a spring positioned between the housing and the control member.

6. The valve according to claim 5, wherein the spring is a compression spring.

7. The valve according to claim 4, wherein the valve member is biased to the open position, wherein a bias on the valve member is less than a bias on the control member.

8. The valve according to claim 7, wherein the valve member is biased by a spring positioned between the housing and the valve member.

9. The valve according to claim 8, wherein the spring is a compression spring.

10. The valve according to claim 1 wherein the control member is provided with at least one operating tab protruding outwardly through an opening in the housing.

11. The valve according to claim 10, provided with two operating tabs positioned diametrically opposite to each other.

12. The valve according to claim 1, wherein the valve member is provided with a liquid collector that is liquid tight and movable to engage the valve seat, the liquid collector having a first inner liquid channel that in the open position of the valve member communicates with a valve passage through the valve seat.

13. The valve according to claim 12, wherein the liquid collector has circumferential inner and outer surfaces, whereas the control member defines a second inner liquid channel communicating with the first inner liquid channel of the liquid collector and has a circumferential inner surface, whereas the at least one air passage is defined as an annular channel that extends between the circumferential outer surface of the liquid collector and the circumferential inner surface of the control member and that debouches into the second inner liquid channel, wherein in the first and second positions of the control member the circumferential inner surface of the control member in a sealing manner engages the circumferential outer surface of the liquid collector for closing said annular channel, whereas in the third position of the control member the circumferential inner surface of the control member disengages the circumferential outer surface of the liquid collector for opening said annular channel.

14. The valve according to claim 13, wherein the annular channel in a region where the annular channel debouches into the second inner liquid channel is provided with turbulators.

15. The valve according to claim 14, wherein the second inner liquid channel of the control member has a narrowed throat in the region where the annular channel debouches into the second inner liquid channel and wherein the turbulators are positioned immediately before said narrowed throat.

16. The valve according to claim 14, wherein the turbulators comprise a circumferential step in the circumferential inner surface of the control member.

17. The valve according to claim 13, wherein in at least one of the circumferential inner surface of the control member and the circumferential outer surface of the liquid collector longitudinal grooves are provided.

18. The valve according to claim 13 wherein the circumferential inner surface of the control member and the circumferential outer surface of the liquid collector taper for defining a tapering annular channel there between.

19. The valve according to claim 1, wherein the outlet is provided with a restrictor.

20. The valve according to claim 1, wherein a connector is provided at an inlet for the valve configured to allow a liquid tight connection between the valve and a spigot or spout of a liquid reservoir.

21. The valve according to claim 12, wherein the liquid collector engages the valve seat through a deformable seal member attached both to the liquid collector and to the valve seat.

22. A liquid dispensing device for use with a flexible bag containing said liquid and having a spigot or spout connected thereto, the liquid dispensing device comprising a device housing configured to receive the flexible bag, wherein the device housing is provided with a receiver configured to receive the spigot or spout, wherein the receiver comprises a valve according to claim 1 wherein an inlet of the valve is provided with a connector configured to provide a liquid tight connection between the valve and the spigot or spout of the flexible bag.

23. The liquid dispensing device according to claim 22, wherein the valve is provided in an upper part of the housing and wherein the housing further is provided with a support member for the flexible bag, wherein the support member is movable between a lowermost position remote from the valve for supporting a full bag and an uppermost position near to the valve for supporting a substantially empty bag.

24. The liquid dispensing device according to claim 23, wherein the support member has an inclined upper support surface sloping down to a side of the valve.

* * * * *